US006475129B1

(12) United States Patent
Lehmann

(10) Patent No.: US 6,475,129 B1
(45) Date of Patent: Nov. 5, 2002

(54) BUCKLE FOLDING MACHINE WITH ADJUSTABLE FOLDING GAP WIDTHS

(75) Inventor: Werner Lehmann, Gutach (DE)

(73) Assignee: Mathias Bäuerle GmbH (DE)

( * ) Notice: Subject to any disclaimer, the term of this patent is extended or adjusted under 35 U.S.C. 154(b) by 0 days.

(21) Appl. No.: 09/443,726

(22) Filed: Nov. 19, 1999

(30) Foreign Application Priority Data

Nov. 20, 1998 (DE) ..... 298 20 796 U

(51) Int. Cl.[7] ..... B31F 7/00
(52) U.S. Cl. ..... 493/421; 493/25
(58) Field of Search ..... 493/421, 23, 25, 493/405, 416, 442

(56) References Cited

U.S. PATENT DOCUMENTS

| | | | | |
|---|---|---|---|---|
| 2,699,331 A | | 1/1955 | McGarvey et al. | |
| 3,089,695 A | | 5/1963 | Brooks | |
| 4,225,128 A | | 9/1980 | Holyoke | |
| 5,026,035 A | * | 6/1991 | Martinez Sanz et al. | 270/45 |
| 5,057,064 A | * | 10/1991 | Michalik | 493/8 |
| 5,242,364 A | * | 9/1993 | Lehmann | 493/8 |
| 5,246,415 A | * | 9/1993 | Fuss | 493/28 |
| 5,871,429 A | * | 2/1999 | Harding et al. | 493/25 |

FOREIGN PATENT DOCUMENTS

| | | |
|---|---|---|
| DE | 24 17 041 C3 | 10/1975 |
| DE | 92 03 930.8 | 7/1992 |
| DE | 92 14 625.2 | 2/1993 |

* cited by examiner

*Primary Examiner*—John Paradiso
(74) *Attorney, Agent, or Firm*—McGlew and Tuttle, P.C.

(57) ABSTRACT

A buckle folding machine is provided with a device with which the folding rollers (W1 through W5) can be automatically set to different folding gap widths as a function of the measured or calculated thickness of a sheet of paper or stack passing through the folding gap (F1 through F4). The folding rollers to be adjusted are mounted on pivoted levers (22), which are mounted coaxially in pairs and which be pivoted against permanent restoring forces under the effect of electrically controllable adjusting members (S1 through S5). The adjusting members are actuated by an electronic process computer, which calculates the folding gap widths to be set in the particular case according to a preset working program from measured and/or manually entered paper thicknesses or stack thicknesses and/or fold types. The adjusting members (S1 through S5) comprise a plurality of pneumatic working cylinders, which are arranged in a row in a cascade-like pattern, and whose working strokes mutually add up. The setting of the folding rollers can thus be performed very rapidly and also temporarily for even a short duration.

18 Claims, 10 Drawing Sheets

Fig. 9

| | 0 | 0,5 | 1 | 1,5 | 2 | 2,5 | 3 | 3,5 | |
|---|---|---|---|---|---|---|---|---|---|
| | * | | | | | | | | = ES 0 |
| A | | * | | | | | | | = ES 1 |
| B | | | * | | | | | | = ES 2 |
| A + B | | | | * | | | | | = ES 3 |
| C | | | | | * | | | | = ES 4 |
| A + C | | | | | | * | | | = ES 5 |
| B + C | | | | | | | * | | = ES 6 |
| A + B + C | | | | | | | | * | = ES 7 |

BUCKLE FOLDING MACHINE WITH ADJUSTABLE FOLDING GAP WIDTHS

FIELD OF THE INVENTION

The present invention pertains to a buckle folding machine with a device for automatically setting the folding rollers to different folding gap widths as a function of the measured or calculated thickness of a sheet of paper or stack passing through the folding gap, wherein the folding rollers to be adjusted are mounted on pivoted levers, which are mounted coaxially in pairs and can be pivoted against permanent restoring forces under the effect of electrically controllable adjusting members and wherein the adjusting members are actuated by an electronic process computer, which calculates the folding gap widths to be set in the particular case according to a preset working program from measured paper thicknesses and/or types of folding and/or from paper thicknesses and/or types of folding entered manually.

BACKGROUND OF THE INVENTION

In a prior-art paper folding machine of this type (e.g., DE-G 92 03 930.8), the folding rollers, which form a folding point each in pairs, are mounted in two-armed pivoted levers, which are present in pairs and can be moved apart against the action of radial spring forces.

These pivoted levers are actuated by adjusting members, by which the distances between the axes of the folding rollers can be set to different folding gap widths by means of self-locking, manually adjustable threaded engagements corresponding to the paper thickness to be processed and the number of paper layers passing through the individual folding points. To determine the folding gap widths of the individual pairs of folding rollers, a programmed process computer with an entry keyboard and a digital display is provided, in which the thickness and the sheet length of the material running in for folding is entered either manually or via electronic analog-digital converters from a thickness-measuring means or a length-measuring means and in which the desired type of folding and/or the set lead lengths of the individual lead limiters are entered.

The folding gap widths calculated by the process computer from the values entered are displayed as digital values and/or are fed in via a control device provided with electronic comparator circuits and power amplifiers. This control device controls gear motors of servo controllers, which bring about the continuous setting of the individual distances between the axes to these folding gap widths, which correspond to a single thickness or a multiple thickness of the material to be folded by means of the threaded engagements provided, and which have as actual value transducers electric or electronic position indicators which are connected to the respective adjusting members.

The thickness-measuring means and the length-measuring means are arranged in a transport path located between a sheet-separating means and an intake point formed by a roller pair. The folding rollers are arranged in relation to one another such that the axes of two folding rollers each are located in the corners of an isosceles rectangular triangle and that one folding roller of a folding roller pair is adjustable in the direction of one leg and the other in the direction of the other leg of the triangle. An optimal arrangement and mounting of the two-armed pivoted lever is thus achieved and it is guaranteed that the individual folding rollers can always be set to different folding gap widths trouble-free and unaffected by the other folding rollers.

Even though the adjusting members provided in this prior-art buckle folding machine, which are driven by electric gear motors and have threaded engagements via which the particular settings of the pivoted levers take place, do make possible an automatic, individual setting of the individual folding rollers, this setting is maintained in this prior-art buckle folding machine over a larger series of operations taking place in the same manner. It is not possible with this prior-art setting device to perform an adjusting of the folding rollers within the frequency of passage in the case of different paper and stack thicknesses immediately following one another.

SUMMARY AND OBJECTS OF THE INVENTION

The primary object of the present invention is to provide a buckle folding machine of the type described in the introduction, in which the setting of the folding rollers to different folding gap widths can take place very rapidly and also temporarily for even a very short duration.

This object is accomplished according to the present invention by the adjusting members consisting of a plurality of pneumatic working cylinders, which are arranged in a row in a cascade-like pattern and whose working strokes mutually add up.

Due to the design of the adjusting members according to the present invention and their pneumatic mode of operation, it is possible to change the particular settings of the individual folding rollers to certain folding gap widths in a rapid sequence corresponding to a high frequency of passage, and it is possible with other embodiments to set more standardized intermediate values between a minimum and a maximum folding gap width than the number of working cylinders in an adjusting manner.

For example, using three working cylinders arranged in an adjusting member, which have three different working strokes, it is possible to set eight different folding gap widths on a pair of rollers, in which pressure is admitted to the three working cylinders in different combinations.

An embodiment of the present invention is advantageous for actuating the individual working cylinders, because simple, reliable control elements operated at a high switching speed thus guarantee a reliable mode of operation.

A very simple, compact design with high reliability of operation, which can be manufactured without problems, is achieved with an embodiment of the invention.

An embodiment ensures the trouble-free admission of pressure and high speed of response of the individual working cylinders and their working pistons with simple means.

Due to the control valves being integrated in groups a clear, simple design of the control units is obtained, on which possible causes of disturbance care also be rapidly recognized.

An embodiment is also used to reach a high speed of response of the individual working cylinders.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 9 is as an example a table of folding gap widths that can be set; and

DESCRIPTION OF THE PREFERRED EMBODIMENTS

Figure 1:
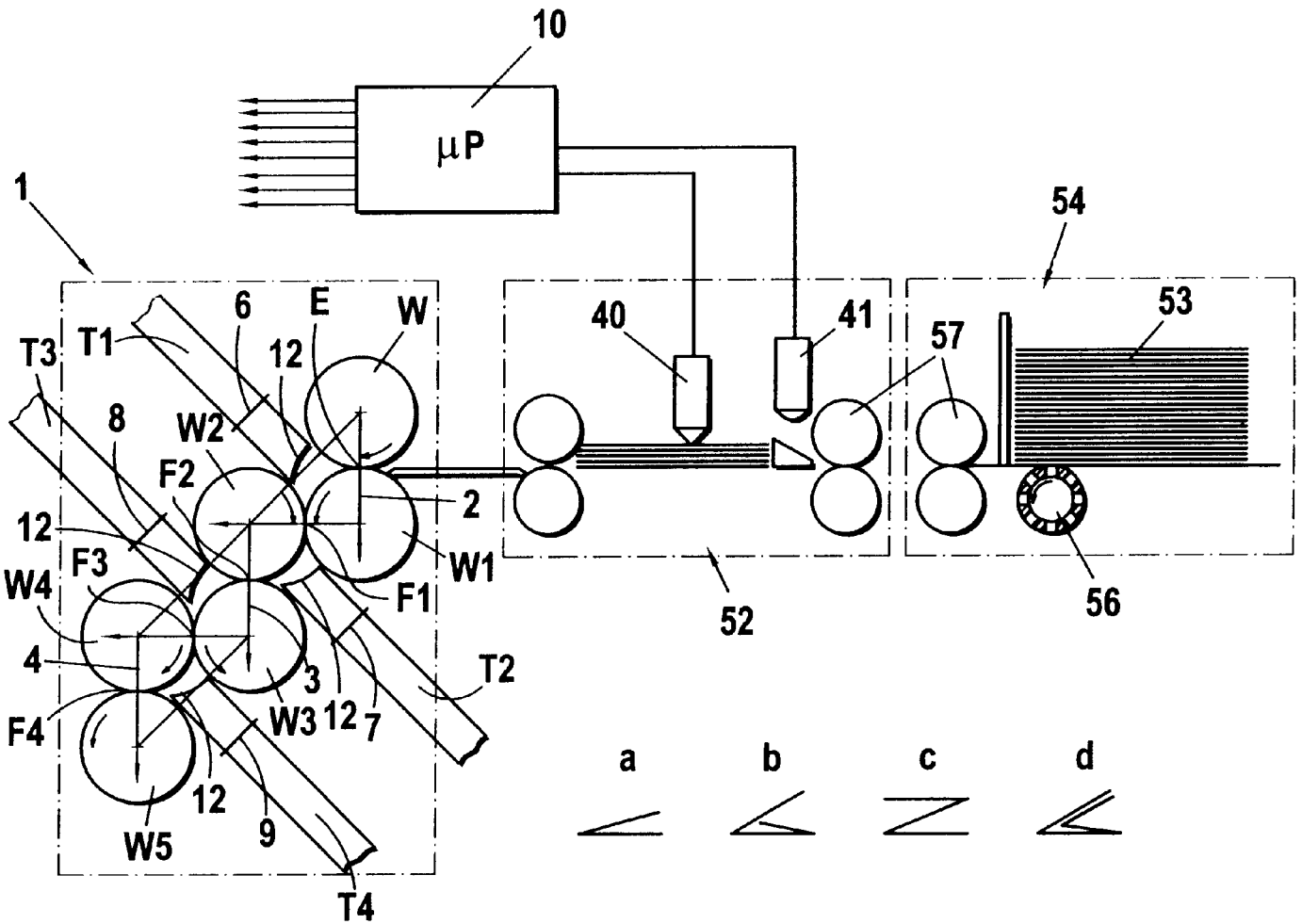
FIG. 1 is a simplified schematic representation of a buckle folding machine with a collecting point arranged in front of it and with a sheet feeding mechanism arranged in front of this.

Referring to the drawings in particular, a buckle folding machine 1, which is shown only schematically in FIG. 1, has a total of five folding rollers W1 through W5 and, in addition, an intake roller W, which forms an intake point E with the first folding roller W1. This intake point E is located at the site where the two rollers W and W1 touch each other or have the shortest distance from one another. The folding roller W1 forms the first folding point F1 with the folding roller W2, while the other folding rollers W2 through W5 form, in pairs with one another, the folding points F2, F3 and F4. The axes E1 of the intake roller as well as A1 through A5 of the folding rollers W1 through W5 are located in the corners of isosceles rectangular triangles 2, 3 and 4, which are indicated by dash-dotted lines in FIG. 2.

Figure 2:
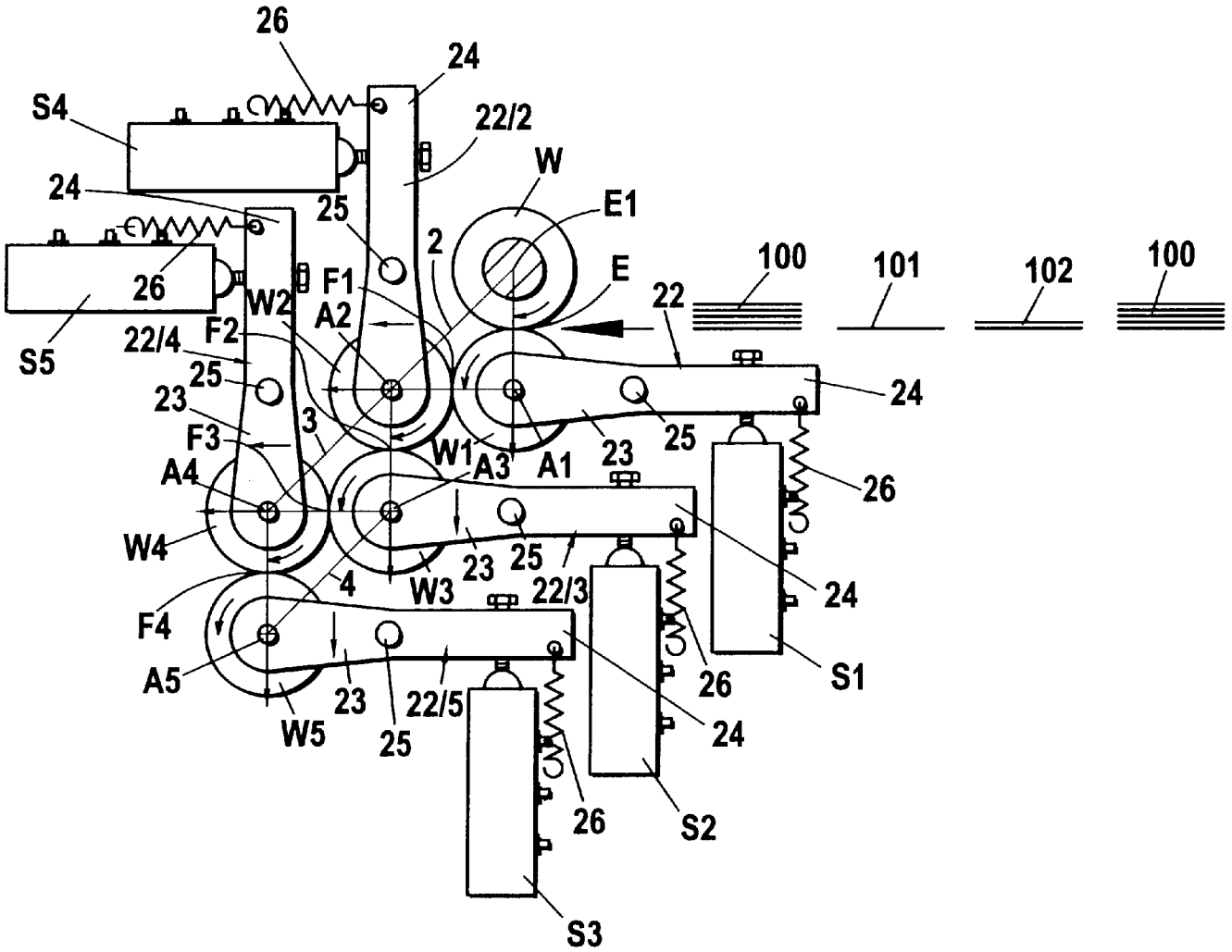
FIG. 2 is a schematic side view of the arrangement of the individual folding rollers and of the pivoted levers with their adjusting members.

While the intake roller W is mounted stationarily and nonadjustably, each of the folding rollers W1 through W5 is radially adjustable in relation to the folding rollers W1 through W4, which cooperate with it and form either the intake point E or a folding point F1 through F4 radially in the direction of the arrows shown in FIG. 2. The intake gap at the intake point E can thus be set to the thickness of the arriving paper or paper stack of the material to be folded and the folding gap widths at the individual folding points F1 through F4 can be set to the optimal size. The folding rollers W1, W3 and W5 are adjustable in the vertical direction radially in relation to the respective superjacent rollers W and W2 and W4, while the folding rollers W2 and W4 are adjustable in the horizontal direction in relation to the folding rollers W1 through W3.

As is common in buckle folding machines, obliquely positioned folding pockets T1, T2, T3 and T4, whose paper stops 6, 7, 8 and 9 are set either manually or automatically, controlled by a process computer 10, according to a preset program, are present in front of the individual folding points F1 through F4. Likewise, the paper deflectors 12, which are individually associated with each folding pocket T1, T2, T3 and T4 and by which the individual folding pockets T1, T2, T3 and T4 can be closed if needed, can be brought manually and/or automatically by the process computer 10 into the position needed for the particular folding program set.

To adjust and position the paper stops 6 through 9 in the folding pockets T1 through T4, devices are provided, which can be driven by an electric motor and can be likewise controlled by the process computer 10, in which all the data necessary for setting the lead lengths in the individual folding pockets T1 through T4, e.g., the length of the basic format of the material to be folded, the shape of the fold, and the desired length of the final format, can be entered via a connected keyboard 21, and, on the whole, the new known, different fold forms can be selected.

Figure 10:
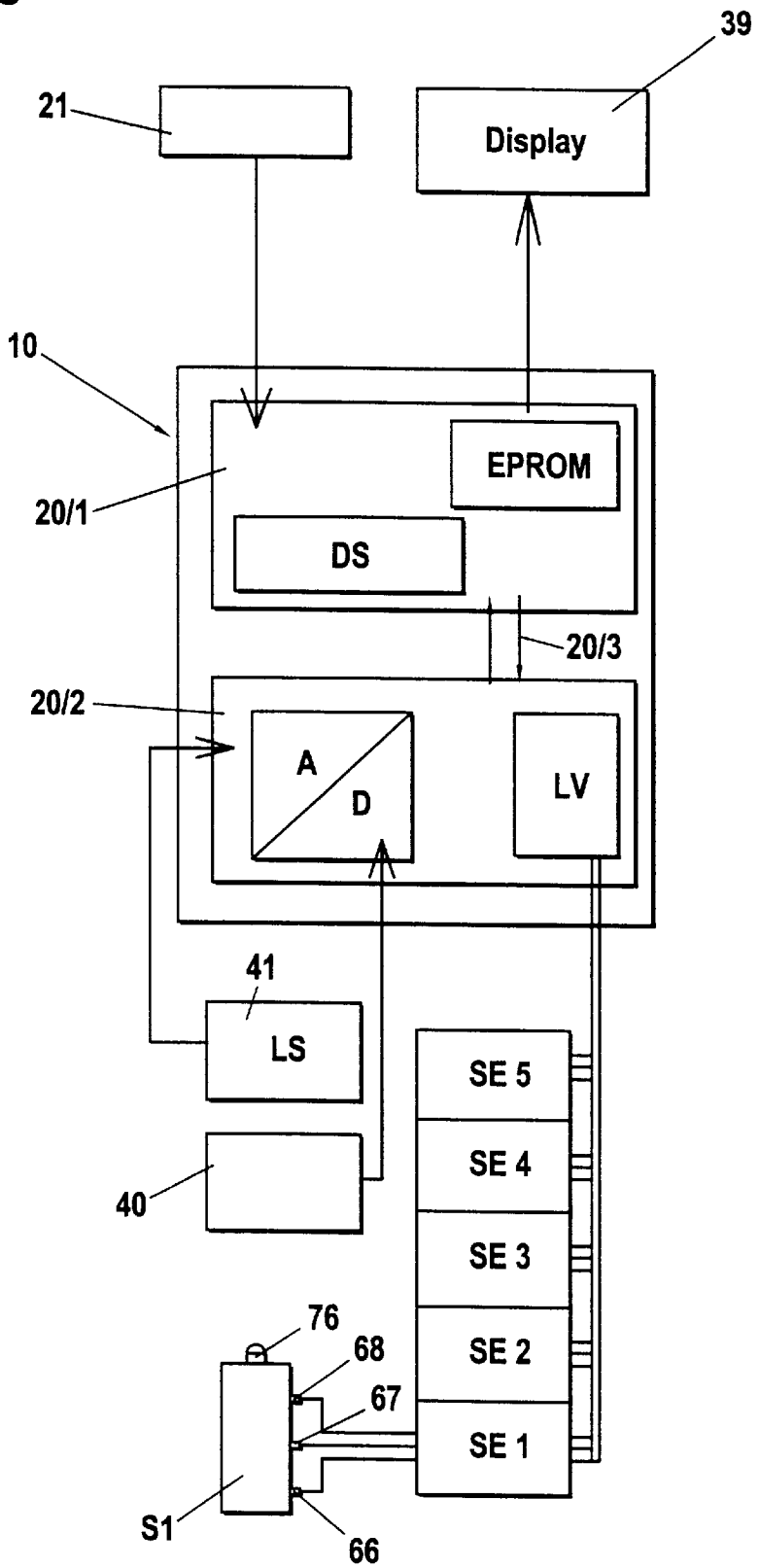
FIG. 10 is a schematic block diagram of the electric and electronic control devices with a microprocessor.

As can be recognized from the schema tic representation in FIG. 10, the process computer 10 comprises a main processor 20/1 and a lower-level, second processor (slave processor) 20/2. The keyboard 21, via which the operator can enter the set points and the parameters, is connected to the main processor 20/1. In addition, a digital display device in the form of a display 39, which has a plurality of display fields for displaying the values that happen to be of interest, is connected to it. In addition, this main processor 20/1 is able to store values and parameters that are needed for the operation of the buckle folding machine 1 even in the switched-off state, so that they do not need to be re-entered each time as long as no change is necessary.

It is provided for this purpose with an electronic memory DS, in which these values and parameters are kept available for polling for the calculation of the folding gap widths to be determined and to which, e.g., four signal transmitters or actual value transducers can be connected.

The working program of the processor computer 10, by which program the desired values are determined or calculated from the desired parameters, is contained in an EPROM, i.e., an erasable programmable read-only memory. The second processor 20/2 performs the setting of the folding gap widths proper and optionally also the setting of the lead lengths, e.g., by correspondingly setting the paper stops 6 through 9 in the folding pockets T1 through T4. This second processor 20/2 is connected via an interface 20/3 with the main processor 20/1 for exchanging data and is provided with an external power amplifier LV, via which it controls the control units SE1, SE2, SE3, SE4 and SE5 for setting the folding gap widths. Both analog signal transmitters and an automatic paper and stack thickness-measuring mechanism 40 are connected to the second processor 20/2 via an analog-digital converter unit A/D), while an automatic sheet-counting mechanism 41 is connected to it directly.

It can be recognized from the fold forms a, b, c and d shown schematically in FIG. 1 that the number of paper layers with which the material being folded passes through the individual folding points F1 through F4 may differ. This means that the folding gap widths of the individual folding points F1 through F4 can correspond to the thickness of a single sheet of paper or of a single stack or of a plurality of sheets or stacks if they are to be set optimally. It should also be taken into account the paper thicknesses of the particular material to be folded may differ greatly.

The setting of the optimal folding gap widths is necessary to achieve a high accuracy of folding rapidly. To make it possible to set these optimal folding gap widths in a short time and optimally during the operation of the buckle folding machine 1, a setting mechanism is provided for each of the individual folding rollers W1 through W5 at the two ends of the rollers. This is shown as an example in FIG. 8 for the folding roller W1 for setting the gap widths at the intake point E.

As was mentioned before, the intake roller W is mounted stationarily, i.e., rotatably in radially nonmovable bearings 13 in two frame plates 14 and 15. In contrast, the first folding roller W1, like the other folding rollers W2 through W5, is mounted on a lever arm 23. Each lever arm 23 is of a bearing part, which consists of a two-armed pivoted lever 22. The lever 22 is pivotable on bearing journals 25 around a drag bearing that is parallel to the axis of the roller, and whose second lever arm 24 is under the effect of a tension spring 26 such that the folding roller W1 is pressed radially from below against the intake roller W.

To change the distance between the axes and to set a certain folding gap width at the intake point E, the second lever arm 24 of the pivoted lever 22 is provided with an adjusting screw 27, which is seated on an adjusting member S1, which can be activated and is arranged stationarily in the frame of the folding machine.

Figure 8:
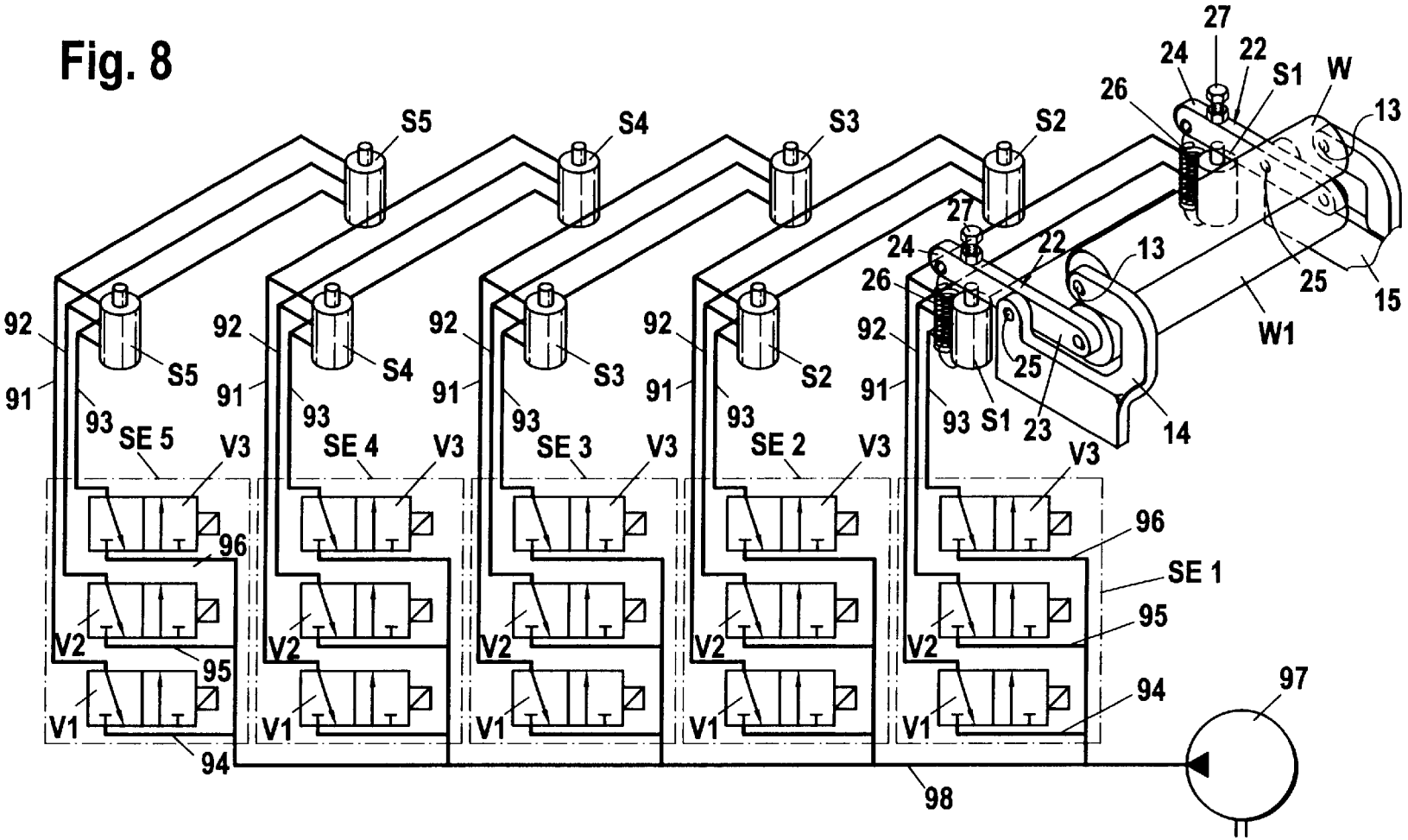
FIG. 8 is a schematic, partially perspective block diagram of the adjusting members, which are present in pairs and are associated with an adjustable folding roller, with the individual pneumatic control units and a pair of rollers.

As is apparent from FIG. 8, two such adjusting members S1 are present, which at the same time can also actuate the pivoted levers 22 of the folding roller W1, which are likewise present in pairs. Two adjusting members S2, S3, S4 and S5 are also associated with the other pivoted lever pairs 22/2, 22/3, 22/4 and 22/5 shown in FIG. 2, and the adjusting members S1, S2 and S3 assume a vertical position and the two adjusting members S4 and S5 are in a horizontal position. It is ensured as a result that the adjusting members S1 through S5 associated with the individual pivoted levers 22 through 22/5 are arranged at right angles to the respective lever arms 24 that they actuate.

These adjusting members Si through S5 have the same design. They each comprise a plurality of pneumatic working cylinders 61, 62, 63, three such working cylinders in the exemplary embodiment according to FIG. 3, which are arranged in a row in a cascade-like pattern and whose working strokes mutually add up. These working cylinders 61, 62, 63 are arranged coaxially to one another axially displaceably in a common housing cylinder 65. They each comprise a cylindrical housing body 70 with a front wall 71 inserted in an air-tight manner and a second front wall 72 made in one piece. Thrust pistons 73 with sealing rings 74 are mounted axially movably in the likewise cylindrical cavities of the housing bodies 70. These thrust pistons 73 are provided with a cylindrical thrust plunger 76 that movably passes through a central axial hole 75 of the fixed front wall 72. A spacing bolt 77 each, which defines the starting position or the resting position of the thrust piston 73 by being in contact with its lower end with the corresponding front wall 71, is provided on the side of the thrust piston 73 located opposite this thrust plunger 76. The cavity located between the front wall 71 and the thrust piston 73 forms a pressure chamber 78 of the respective working cylinder 61, 62 or 63. The cavity 79 located between the thrust piston 73 and the fixed front wall 72 is connected through axial holes 80 to the respective cavity 81 and 82 of the housing cylinder 65 located between two respective working cylinders 61 and 62 and 62 and 63, and the said cavity 79 of the working cylinder 63 is directly connected to the outside through the axial holes 80.

The cavities 81 and 82 of the working cylinder 65 located between two working cylinders 61 and 62 and 63 each are connected to the outside air through respective radial holes 83 and 84.

These cavities 81 and 82 are each formed by the front walls 71 of the working cylinders 62 and 63 being in contact with the thrust plunger 76 of the respective working cylinder 62 and 61 located in front of it as a consequence of the pulling action of the tension spring 26 and by these thrust plungers 76 also projecting from the upper front wall 72 in their resting position in order to maintain a minimum axial distance between the respective adjacent working cylinders 61 and 62 and 62 and 63.

To ensure this external connection through the radial hole 84 in the middle working cylinder 62 even after an axial displacement relative to the radial hole 84, the working cylinder 62 is provided on the outside at its upper end section with a ring fold 87, by which the radial hole 84 is still in connection with the cavity 82 being displaced even when the working cylinder 62 has been displaced in the direction of the working cylinder 63 together with this.

Both the radial holes 83 and 84 in the housing cylinder 65 and the axial holes 80 in the front walls 72 of the working cylinders 61, 62 and 63 are used alternatingly as pressure release and ventilating channels for the air chambers 79 of the three working cylinders 61 through 63. To reach the highest possible working speed of the working cylinders 61, 62 and 63, it is advantageous for the radial holes 83 and 84 and the axial holes 80 to be present as a plurality of holes, so that the largest possible volume of air can penetrate into or escape from the cavities 81 and 82 and 79 in a very short time during the displacement of a thrust piston 73 and of one of the working cylinders 61, 62, 63 itself.

The working cylinders 61, 62 and 63 are provided each with at least one radial inlet hole 85 in the axial area of their pressure chambers 78. In the working cylinders 62 and 63, which are axially movable relative to the working cylinder 61 seated on a lower, front-side support wall 88, these inlet holes 85 are located in a circular circumferential groove 86, whose respective axial length L1 and L2 extends over an amount that corresponds to the sum of the individual working strokes h1 and h2 of the respective thrust pistons 73 located in the front. In this case, it is the working strokes of the thrust pistons 73 of the two working cylinders 62 and 63. The circumferential grooves 86 of the working cylinders 61 through 63 are sealed by two ring seals 90 each in the two axial directions. To supply the individual working cylinders 61, 62 and 63 with compressed air, the housing cylinder 65 is provided with compressed air connections 66, 67 and 68, which all open into a circumferential groove 86. Since the working cylinder 61 in the housing cylinder 65 does not move, the axial extension or length of its circumferential groove 86 only needs to correspond approximately to the hole diameter of the compressed air connection 66 or to the diameter of its inlet hole 85.

The number of compressed air connections 66, 67 and 68 thus corresponds to the number of the working cylinders 61, 62 and 63 arranged in the housing cylinder 65, so that compressed air can be admitted to each working cylinder 61,62 and 63 individually and independently from the other two working cylinders, which is brought about by compressed air being introduced into the pressure chamber 78 of the corresponding working cylinder 61, 62 and 63.

Due to compressed air being admitted into the working cylinders 61, its thrust piston 73 displaces the two working cylinders 62 and 63 located behind it via the thrust plunger 76 by the amount of its working stroke h1 in the stationary housing cylinder 65. When pressure is admitted to the working cylinder 62, its thrust piston 73 displaces the working cylinder 63 via the thrust plunger 76 by the working stroke h2 performed by the thrust piston in the working cylinder 62. The thrust piston 73 of the working cylinder 63 actuates the lever arm 24 of the pivoted lever 22 directly. The working strokes h1, h2 and h3 of the individual thrust pistons 73 thus add up during the simultaneous admission of pressure.

Figure 3:
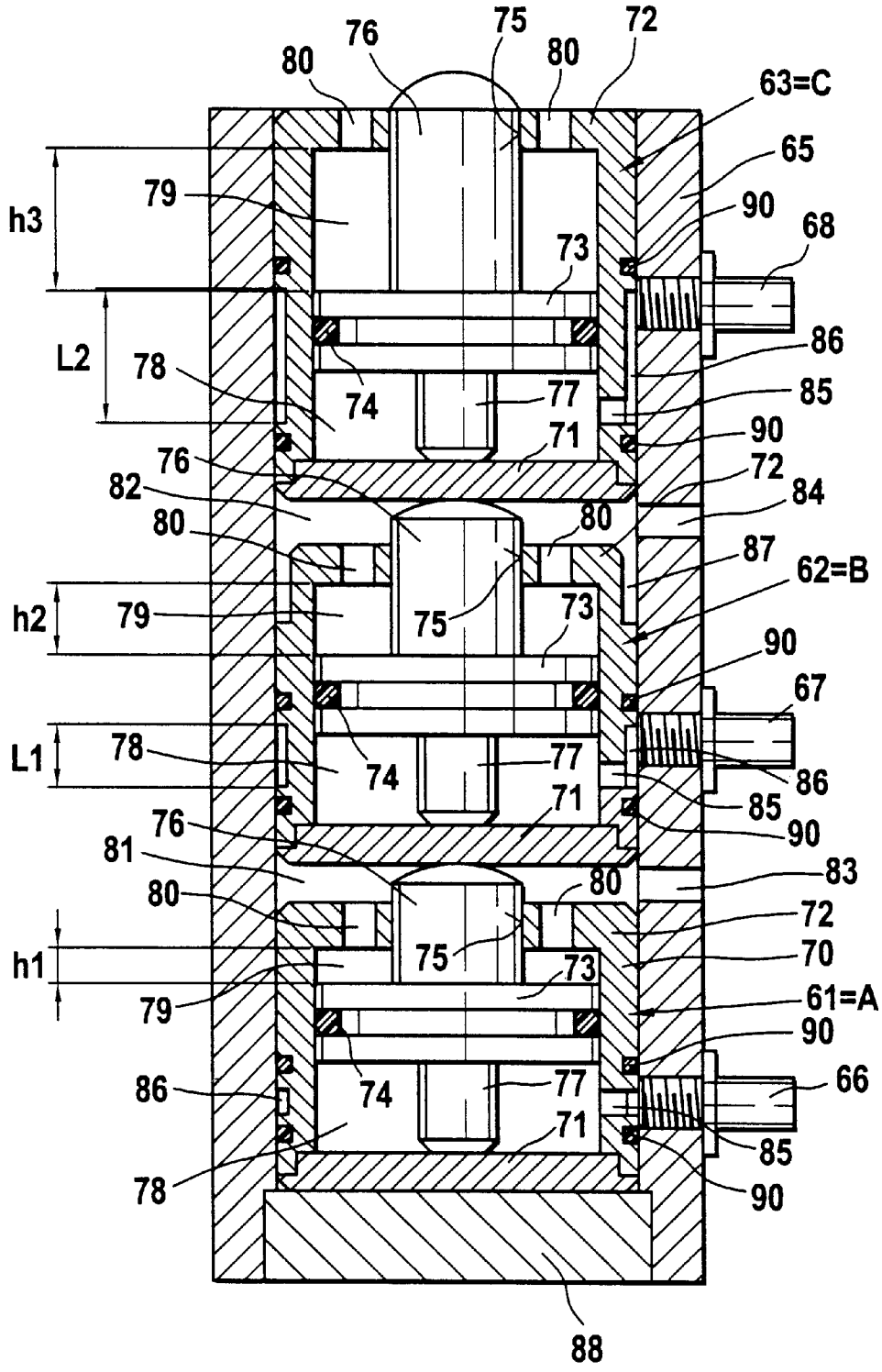
FIG. 3 is a greatly enlarged sectional view of an adjusting member.
Figure 4:
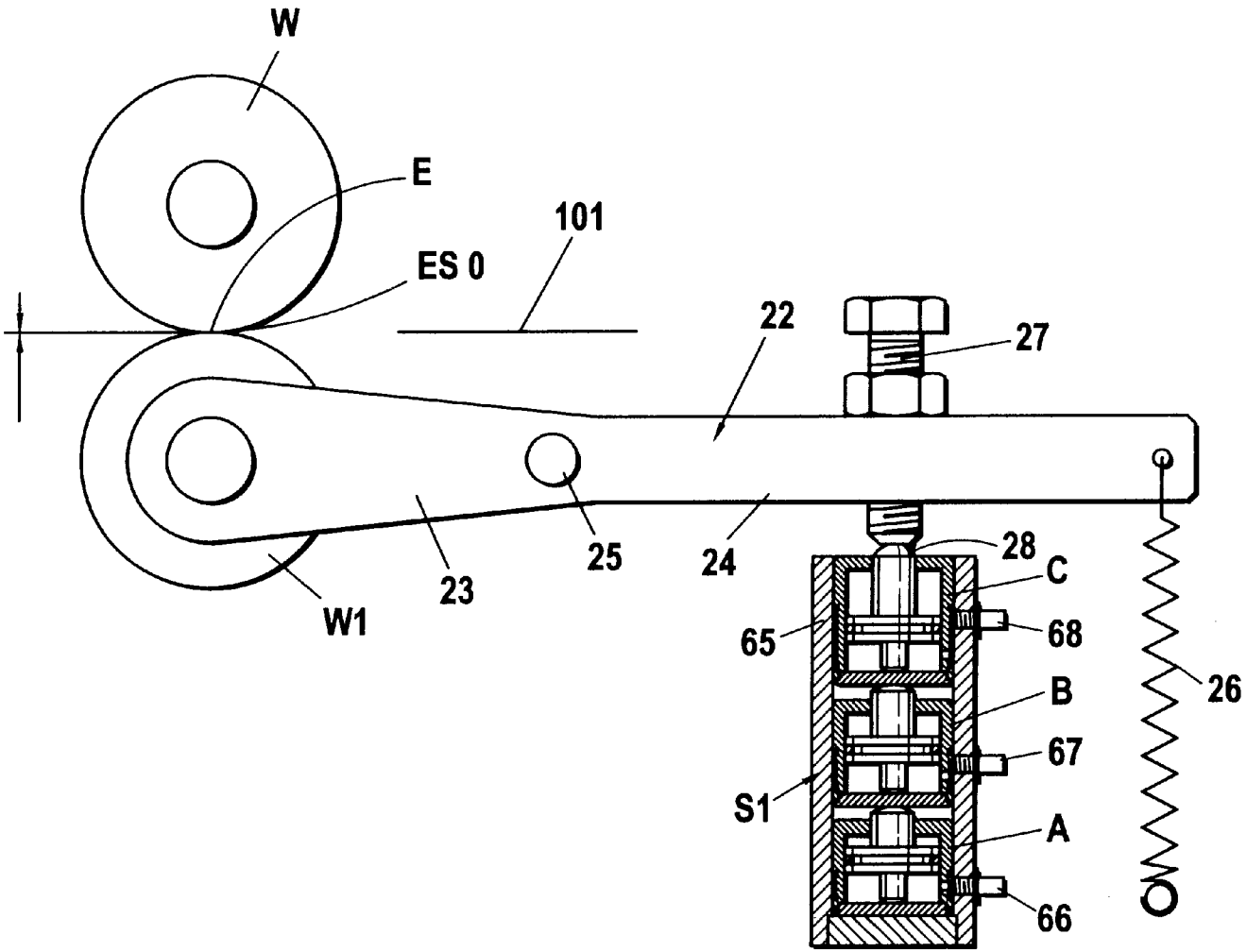
FIG. 4 is a schematic side view of the first folding roller with its pivoted lever, which folding roller is set at a folding gap width to the intake roller, and also showing the sectional view of the adjusting member associated with this pivoted lever.
Figure 5:
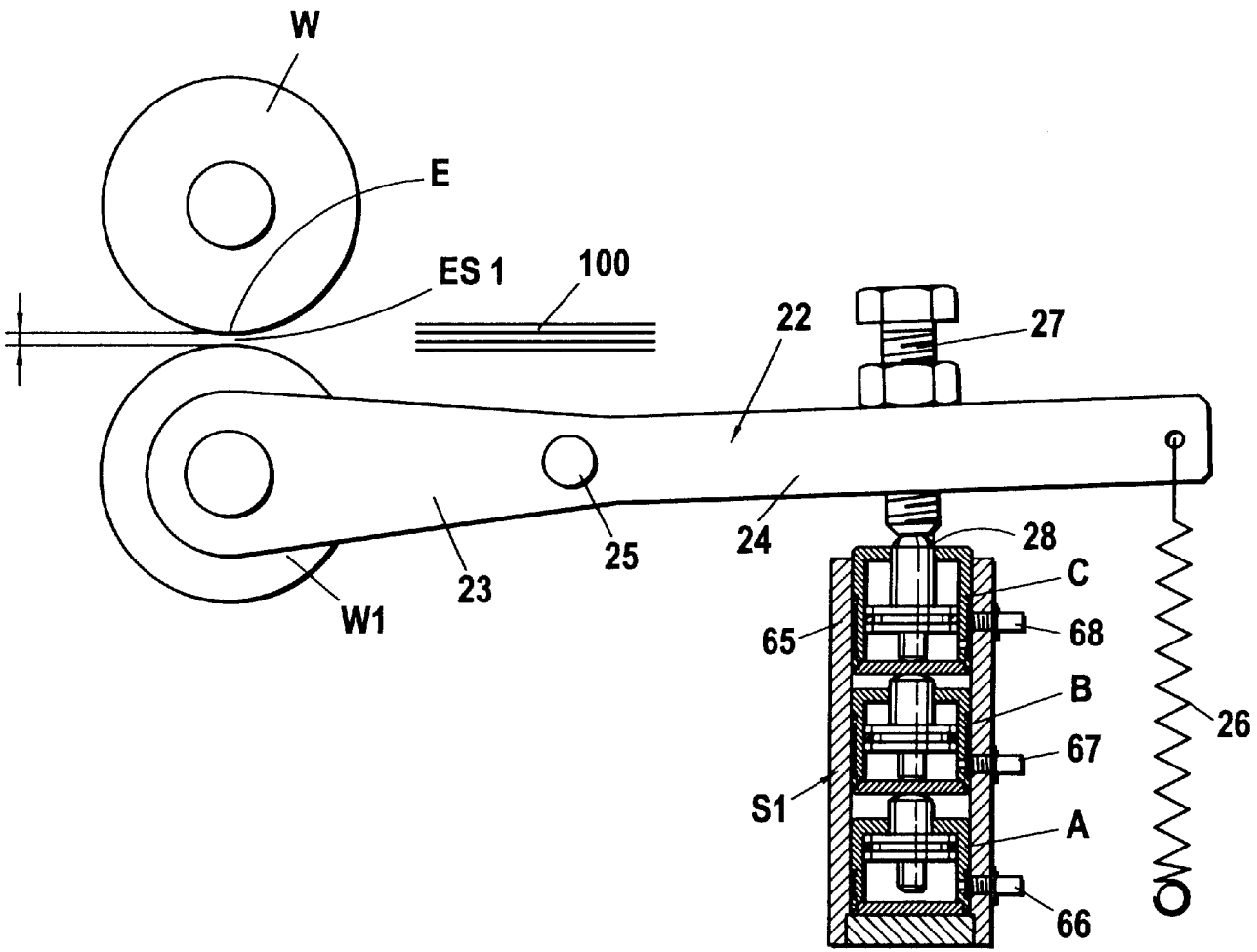
FIG. 5 is a schematic side view of the first folding roller with its pivoted lever, which folding roller is set at a folding gap width, which is different from the gap width set in FIG. 4, to the intake roller, and also showing the sectional view of the adjusting member associated with this pivoted lever.
Figure 6:
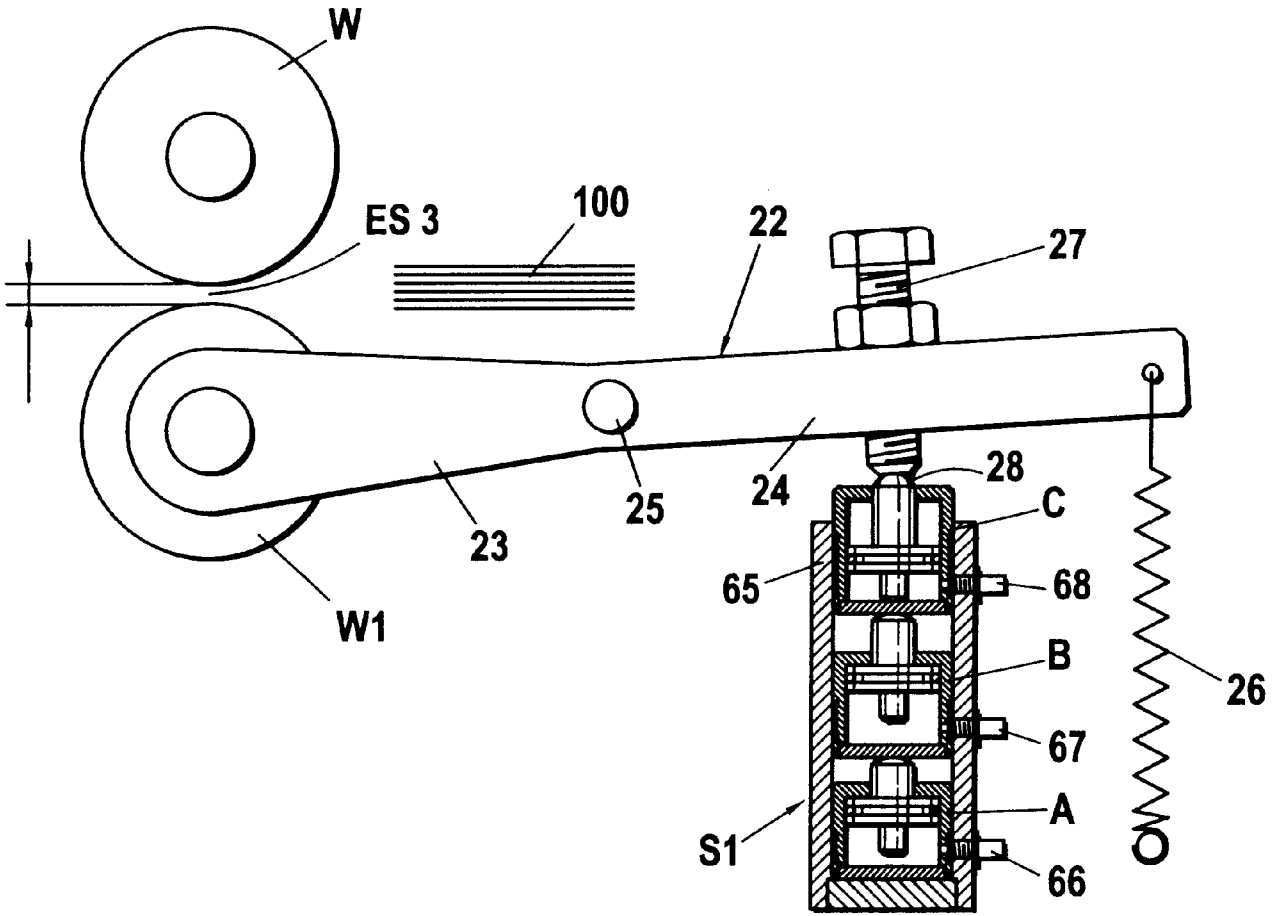
FIG. 6 is a schematic side view of the first folding roller with its pivoted lever, which folding roller is set at a folding gap width, which is different from the gap width set in FIG. 4, to the intake roller, and also showing the sectional view of the adjusting member associated with this pivoted lever.
Figure 7:
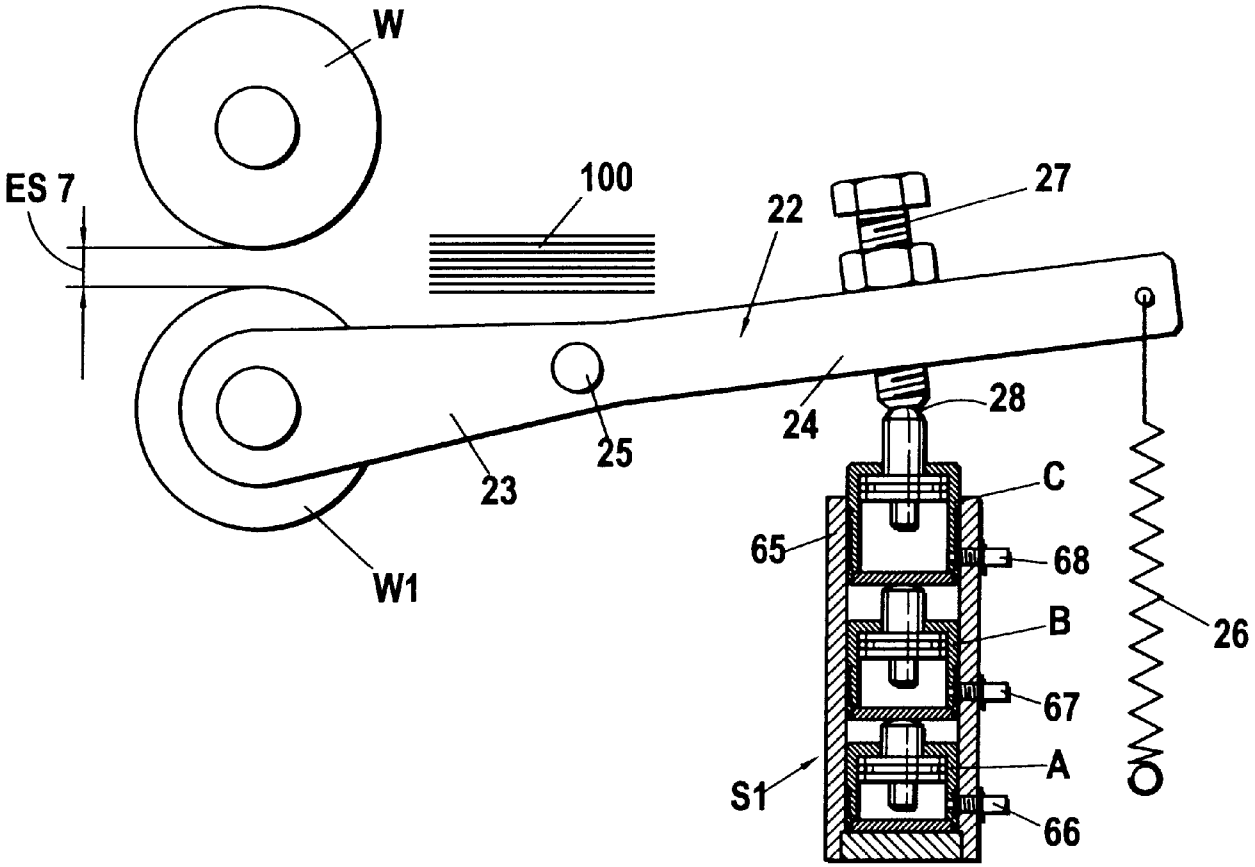
FIG. 7 is a schematic side view of the first folding roller with its pivoted lever, which folding roller is set at a folding gap width, which is different from the gap width set in FIG. 4, to the intake roller, and also showing the sectional view of the adjusting member associated with this pivoted lever.

It can be recognized from FIG. 3 that the axial distances between the thrust pistons 73 and the fixed front walls 72 of the individual working cylinders 61 through 63 are different, so that the working strokes h1, h2 and h3 are also different. The working stroke h1 of the working cylinder 61 is 0.5 mm in this exemplary embodiment, the working stroke h2 of the working cylinder 62 is 1 mm, and the working stroke h3 of the working cylinder 63 is 2 mm. If the zero position is included, a total of eight different stroke settings are obtained from this on the thrust plunger 76 of the topmost working cylinder 63 and consequently also a total of eight different possibilities of setting on the pivoted levers 22 and the folding rollers W1 through W5 fastened thereto.

These possibilities of combination are indicated by asterisks in the table in FIG. 9, in which the working cylinder 61 is designated by the letter A, the working cylinder 62 by the letter B, and the working cylinder 63 by the letter C, and in which the cylinders to which compressed air is being admitted are shown in the first column. It can be determined from this table that a working stroke h1 of 0.5 mm is generated in the case of admission of compressed air into the working cylinder A, a working stroke h2 of 1 mm is generated in the case of the admission of compressed air into the working cylinder B, and a working stroke h3 of 2 mm is generated upon the admission of compressed air into the working cylinder C, and that working stroke combinations of 1.5 mm, 2.5 mm and 3.5 mm can be obtained in the case of the combinations A+B and A+C and B+C and A+B+C, which are also shown.

If the leverage of the first lever arm 23 to the second lever arm 24 is assumed to be 1:1 in the pivot arms 22 through 22/5, this means that the folding gap widths ES0, ES1, ES3 and ES7 shown in FIGS. 4, 5, 6 and 7 also equal 0 mm and 0.5 mm and 1.5 mm and 3.5 mm, respectively. It can also be recognized from FIGS. 4 through 7 that the adjusting screw 27 is in contact with the top face 28 of the thrust plunger 76 of the topmost working cylinder C(63).

As is apparent from FIG. 8, pneumatic control units SE1, SE2, SE3, SE4 and SE5 are present in the adjusting members S1 through S5, which are always actuated in pairs, for individually admitting pressure to the working cylinders 61, 62 and 63. The control units SE1 through SE5, which are of the same design, have three 2/3-way valves V1, V2 and V3 each, whose outlets are connected via pressure lines 91, 92 and 93 to the compressed air connections 66, 67 and 68, respectively, of the individual adjusting members Si through S5. The inlets of the 2/3-way valves V1, V2 and V3 are in turn connected to a compressed air source, e.g., a compressor 97, via compressed air lines 94, 95 and 96 as well as via a distributor line 98.

The individual 2/3-way valves V1, V2 and V3 of the control units SE1 through SE5 are actuated via the power amplifier LV of the process computer 10 as a function of the data that are supplied to the process computer 10 by the paper and stack thickness-measuring mechanism 40 and the sheet-counting mechanism 41.

FIG. 2 schematically shows that, e.g., a thick stack of paper 100, a single sheet 101, a double sheet 102 and then again a thick stack of paper 100, which are always detected by the paper or stack thickness-measuring mechanism, may enter the folding machine one after the other. The folding rollers, such as W1, W2, W3, W4 and W5, are correspondingly set to the calculated, optimal folding gap width, which is shown as an example in the table in FIG. 9.

The pneumatic working pressure which is admitted to the thrust pistons 73 of the individual working cylinders 61, 62 and 62 individually or jointly and with which these are actuated individually or jointly may be, e.g., 6 bar.

The resetting springs 26 have the task of rapidly returning the pivoted levers 22 and the working cylinders 62 and 63 and the thrust pistons 71 of all working cylinders 61, 62 and 63 into their starting positions in order to set the particular folding gap width to zero when the admission of pressure is terminated. The pressure lines 91, 92 and 93 must also be disconnected from the inlet-side pressure line 94 and 95 and 96, respectively, and be, switched free at the same time with the corresponding switch-over of the activated valves V1, V2 and/or V3, so that the air present in the pressure chambers 78 can rapidly escape into the atmosphere. Corresponding line cross sections are needed to guarantee this.

As is known per se, the buckle folding machine 1 is preceded by a sheet collecting mechanism 52, in which stacks of sheets, which consist of different amounts of sheets of paper and therefore also have different stack thicknesses, can be formed according to a certain program. As is shown in FIG. 1, the individual sheets of paper are fed in from a paper stack 53 of a decollating device 54, from which the individual sheets of paper are pulled off from the paper stack 53, e.g., by means of a suction roll 56 and are transported through conveying roller pairs 57 into the sheet-collecting device 52.

The thickness-measuring mechanism 40 and the sheet-counting mechanism 41, which are arranged in this sheet-collecting device 52, are connected, as was described, to the process computer 10 and are used as signal transmitters for the sheet or stack thickness being measured and for the number of the single sheets having accumulated to form a stack. While specific embodiments of the invention have been shown and described in detail to illustrate the application of the principles of the invention, it will be understood that the invention may be embodied otherwise without departing from such principles.

What is claimed is:

1. A buckle folding machine, comprising:

a plurality of pivot levers;

a plurality of folding rollers, each of said folding rollers being mounted on a respective one of said pivot levers, mounted in pairs to define a plurality of folding gaps each having a respective folding gap width;

a restoring force mechanism acting on said pivot levers, said pivot levers being pivotable against a restoring force of said restoring force mechanism;

electrically controllable adjusting members each for acting on a respective one of said pivot levers to automatically set said folding rollers to different folding gap widths as a function of the measured or calculated thickness of a sheet of paper or stack which is to pass through the respective folding gap, said adjusting members each comprising a plurality of pneumatic working cylinders arranged in series in a cascade-like pattern, each of said working cylinders having a working stroke which mutually add up; and an electronic process computer which calculates the folding gap widths to be set in a particular case according to a preset working program from measured and/or manually entered paper thicknesses or stack thicknesses and actuates said electrically controllable adjusting members to provide a desired folding gap width at the respective folding gaps.

2. The buckle folding machine in accordance with claim 1, wherein each said working stroke of said working cylinders is different for said adjusting members.

3. The buckle folding machine in accordance with claim 2, wherein a working stroke of one of said working cylinders of each of said adjusting members always twice the working stroke of the respective adjacent working cylinder in the series.

4. The buckle folding machine in accordance with claim 1, wherein said electrically controllable adjusting members each include electromagnetic 2/3-way valves, pneumatic pressure being admitted to said working cylinders in pairs through said electromagnetic 2/3-way valves, which are connected to a common compressed air source and which are actuated individually by said process computer.

5. The buckle folding machine in accordance with claim 1, wherein said working cylinders of each of said adjusting members are arranged coaxially to one another and axially displaceably in a common housing cylinder such that the working strokes of said individual working cylinders bring about axial displacements of said working cylinder or working cylinders following them in space, where said axial displacements correspond to their amount, and a working piston of said working cylinder that is the last in the series acts directly on said pivot lever.

6. The buckle folding machine in accordance with claim 5, wherein in the axial area of said common housing cylinders, said working cylinders have at least one radial inlet hole, which is located in a corresponding circular circumferential groove, whose axial length extends over an amount that corresponds to a sum of said working strokes of said respective thrust piston located in front of it and that the common housing cylinder is provided with a number of compressed air connections which all open into one of said corresponding circular circumferential groove.

7. The buckle folding machine in accordance with claim 6, wherein said circumferential grooves of said individual working cylinders are each sealed by at least two circumferential joints in both axial directions.

8. The buckle folding machine in accordance with claim 6, wherein said compressed air connections of each housing cylinder are each connected to an outlet of a 2/3-way valve which forms a control unit for said folding rollers together with the 2/3-way valves of the other compressed air connections of said housing cylinder.

9. The buckle folding machine in accordance with claim 5, wherein both said working cylinders and said housing cylinders accommodating said working cylinders are provided with pressure release openings.

10. A buckle folding machine, comprising:

a plurality of pivot levers;

a plurality of folding rollers, each of said folding rollers being mounted on a respective one of said pivot levers, mounted in pairs to define a plurality of folding gaps each having a respective folding gap width;

a restoring force mechanism acting on said pivot levers, said pivot levers being pivotable against a restoring force of said restoring force mechanism;

electrically controllable adjusting members for acting on said pivot levers to automatically set said folding rollers to different folding gap widths as a function of the measured or calculated thickness of a sheet of paper or stack which is to pass through the respective folding gap, said adjusting members each comprising a plurality of pneumatic working cylinders each having a working stroke, said cylinders being capable of actuation at a frequency up to a frequency of sheets being processed by said machine, each working stroke of said plurality of pneumatic working cylinders of each respective one of said adjusting members contributing to an adjusting member output, of each respective one of said adjusting members, acting on the respective one of said pivot levers;

a folding gap width input providing a folding gap input signal;

an electronic process computer for calculating a folding gap width for each of said plurality of folding gaps based on said folding gap input signal and based on a preset working program and for selectively actuating said plurality of pneumatic working cylinders of each of said electrically controllable adjusting members at a frequency up to a frequency of sheets being processed by said machine, to set each adjusting member output to provide a desired folding gap width at the respective folding gaps.

11. The buckle folding machine in accordance with claim 10, wherein said folding gap input comprises one of a sheets thickness measurement device or a key input for providing said folding gap input signal from measured and/or manually entered sheet thicknesses or sheet stack thicknesses.

12. The buckle folding machine in accordance with claim 11, wherein each working stroke of said plurality of pneumatic working cylinders of each respective one of said adjusting members is different for said respective one of said adjusting members.

13. The buckle folding machine in accordance with claim 11, wherein said electrically controllable adjusting members each include electromagnetic 2/3-way valves, pneumatic pressure being admitted to said working cylinders in pairs through said electromagnetic 2/3-way valves, which are connected to a common compressed air source and which are actuated individually by said process computer.

14. The buckle folding machine in accordance with claim 11, wherein said working cylinders of said adjusting members are arranged coaxially to one another and axially displaceably in a common housing cylinder such that said working strokes of said individual working cylinders bring about axial displacements of said working cylinder or said working cylinders following them in space, where said axial displacements correspond to their working strokes, and a working piston of said working cylinder that is the last in the series forms said adjusting member output acting directly on a respective one of said pivot levers.

15. The buckle folding machine in accordance with claim 14, wherein in the axial area of pressure chambers of said working cylinders, said working cylinders have at least one radial inlet hole, which is located in a circular circumferential groove, whose axial length extends over an amount that corresponds to a sum of said working strokes of said respective working cylinders located in front of it and that the common housing cylinder is provided with a number of compressed air connections which all open into one of said circumferential grooves.

16. The buckle folding machine in accordance with claim 15, wherein said circumferential grooves of said individual working cylinders are each sealed by at least two circumferential joints in both axial directions.

17. The buckle folding machine in accordance with claim 15, wherein said compressed air connections of each common housing cylinder are each connected to an outlet of a 2/3-way valve which forms a control unit for said folding rollers together with the 2/3-way valves of the other compressed air connections of said common housing cylinder.

18. A buckle folding machine, comprising:

a first pivot lever;

a second pivot lever;

a first folding roller mounted to said first pivot lever;

a second folding roller mounted to said second pivot lever;

another folding roller, said first folding roller and said another folding roller forming a first folding gap with a first folding gap width, said second folding roller and said first folding roller forming a second folding gap with a second folding gap width;

a first restoring force mechanism acting on said first pivot lever, said first pivot lever being pivotable against a restoring force of said first restoring force mechanism;

a second restoring force mechanism acting on said second pivot lever, said second pivot lever being pivotable against a restoring force of said second restoring force mechanism;

a first electrically controllable adjusting member acting on said first pivot lever to set a position of said first folding roller relative to said another folding roller and to set said first folding gap width, said first adjusting member comprising a first adjusting member pneumatic working cylinder having a first adjusting member working stroke and another first adjusting member pneumatic working cylinder having another first adjusting member working stroke, said first adjusting member working stroke and said another first adjusting member working stroke being additive providing to provide a first adjusting member output acting on said first pivot lever;

a second electrically controllable adjusting member acting on said second pivot lever to set a position of said second folding roller relative to said first folding roller and to set said second folding gap width, said second adjusting member comprising a second adjusting member pneumatic working cylinder having a second adjusting member working stroke and another second adjusting member pneumatic working cylinder having another second adjusting member working stroke, said second adjusting member working stroke and said another second adjusting member working stroke being additive providing to provide a second adjusting member output acting on said second pivot lever;

a folding gap width input providing a folding gap input signal;

an electronic process computer for calculating a first folding gap width and for calculating a second folding gap width as a function of a measured or known thickness of a sheet or a stack of sheets which is to pass through the folding gaps and for actuating said first electrically controllable adjusting member and said second electrically controllable adjusting member to set said first folding gap width and said second folding gap width.

* * * * *